US006349761B1

(12) United States Patent
Liu et al.

(10) Patent No.: US 6,349,761 B1
(45) Date of Patent: Feb. 26, 2002

(54) FIN-TUBE HEAT EXCHANGER WITH VORTEX GENERATOR

(75) Inventors: Min-Sheng Liu; Chi-Chung Wang; Jane-Sunn Liaw; Yu-Juei Chang, all of Hsinchu Hsian (TW)

(73) Assignee: Industrial Technology Research Institute, Hsinchu Hsian (TW)

( * ) Notice: Subject to any disclaimer, the term of this patent is extended or adjusted under 35 U.S.C. 154(b) by 0 days.

(21) Appl. No.: 09/747,999

(22) Filed: Dec. 27, 2000

(51) Int. Cl.[7] ..... F28D 1/04

(52) U.S. Cl. ..... 165/151; 165/150; 165/181; 165/DIG. 503

(58) Field of Search ..... 165/150, 151, 165/152, 153, 181, 182, DIG. 503

(56) References Cited

U.S. PATENT DOCUMENTS

| | | | | | |
|---|---|---|---|---|---|
| 4,449,581 | A | * | 5/1984 | Blystone et al. | 165/151 |
| 5,706,885 | A | * | 1/1998 | Kim | 165/181 |
| 5,975,199 | A | * | 11/1999 | Park et al. | 165/151 |

FOREIGN PATENT DOCUMENTS

| | | | | | |
|---|---|---|---|---|---|
| GB | 2088544 | A | * | 6/1982 | 165/151 |
| JP | 58-213192 | A | * | 12/1983 | 165/151 |
| JP | 361006590 | A | * | 1/1986 | 165/151 |
| JP | 61-83893 | A | * | 4/1986 | 165/151 |
| JP | 62266391-a | | * | 11/1987 | 165/151 |

* cited by examiner

*Primary Examiner*—Henry Bennett
*Assistant Examiner*—Terrell McKinnon
(74) *Attorney, Agent, or Firm*—Rosenberg, Klein & Lee

(57) ABSTRACT

A fin-tube heat exchanger with a vortex generator is disclosed. The heat exchanger includes at least one heat transfer tube extending therethrough. A vortex generator is formed on the fin and includes a plurality of protuberance ribs projected from the fin and centralized with the heat transfer tube. An air flow inlet is defined between adjacent two of the protuberance ribs and an air flow outlet is defined between other adjacent two of the protuberance ribs. The air flow is guided from the air flow inlet, through channels defined between the vortex generator and the at least one heat transfer tube, and passes out of the air flow outlet, thereby speeding the air flow and promoting the heat transfer efficiency of a stagnation area behind the tube, and generating vortexes at the protuberance ribs and the air flow outlet for draining outer air into the surface for better air mixing and promoting the heat transfer efficiency of the fin.

7 Claims, 11 Drawing Sheets

FIN-TUBE HEAT EXCHANGER WITH VORTEX GENERATOR

BACKGROUND OF THE INVENTION

1. Field of the Invention

The present invention relates to a fin-tube fin of a heat exchanger, especially to a fin-tube fin having a vortex generator.

2. Description of the Prior Art

Traditional air conditioner generally contains a compressor, a condenser, an expansion valve, and an evaporator. Normally, a fin-tube heat exchanger is used as the heat exchanger of an air conditioner as shown in FIG. 1. A traditional fin-tube heat exchanger 1 comprises a plurality of fins 11 spaced apart from adjacent ones a proper distance for passing an air flow 13 through gaps between the fins 11. A plurality of heat transfer tubes 12 extend through the fins 11 and each heat transfer tube 12 contains coolant flowing therein for heat dissipation. The main function of the heat exchanger is to facilitate heat exchange between the coolant in the heat transfer tubes 12 and the air around the heat transfer tubes 12. The main function of the fins 11 is to increase the contacting area between the coolant and the air around.

It has been a long term effort in the air conditioner industry to promote the function of the heat exchanger in consideration of power conservation. Some of the published patents have disclosed technique about promoting the heat exchange efficiency of the fins but most of the designs focus on the improvement of the traditional louver type or slit type of fins. For example, in U.S. Pat. No. 4,817,709, issued on Apr. 4, 1989, a fin structure having a slant plate formed by stamping is disclosed. Specifically, the fin has a wavy shape in which several triangular slant plates are formed by stamping and enable the air flow to generate counter-rotating vortexes at two sides of the triangular slant plate. The triangular slant plate is specifically suitable for the wavy-shaped fin not for general shape. Moreover, the heat transfer efficiency caused by the counter-rotating vortexes at two sides of the triangular slant plate is doubtful.

In U.S. Pat. No. 5,207,270, issued on May 4, 1993, a fin-tube heat exchanger is disclosed which has curved angular protuberances and straight protuberances around heat transfer tubes of each fin of the fin-tube heat exchanger. The curved angular protuberances cooperate with the straight protuberances for improving the heat transfer efficiency of the heat exchanger. In U.S. Pat. No. 5,203,403, issued on Apr. 20, 1993, a fin-tube heat exchanger is disclosed which has elliptic protuberances formed around heat transfer tubes of each fin of the fin-tube heat exchanger for promoting the heat transfer efficiency. However, the manufacturing of the heat exchanger is very complicated and high cost therefore need to be improved.

SUMMARY OF THE INVENTION

The primary purpose of the present invention is to provide a new structure of a fin geometry of a heat exchanger which is simple and easily manufactured yet effective in heat transfer. The fin geometry has a vortex generator having a plurality of ribs formed around heat transfer tubes of the fin by which the air flow passing through the heat exchanger can form a vortex effect around the heat transfer tubes for strengthening the mixture of air around thus considerably improving the heat dissipation efficiency of the fin.

Another purpose of the present invention is to provide a new structure of a fin of a heat exchanger which utilizes a pattern of ribs of a vortex generator of the fin to create a vortex effect for increasing the mixture of air and promoting the heat transfer efficiency of a stagnation area behind the heat transfer tube while not increasing the pressure drop significantly. With this new structure, the function of the heat exchanger is promoted and the total operational efficiency of the air conditioner is thus increased.

According to one aspect of the present invention, there is provided a heat exchanger comprising a plurality of fins spaced from each other in parallel and adjacent ones of the fins allowing an air flow to pass through a gap therebetween. A plurality of heat transfer tubes extends through the fins. A vortex generator comprises a plurality of protuberance ribs formed on the fin and centralized with the heat transfer tube. An air flow inlet is defined between adjacent two of the protuberance ribs and an air flow outlet is defined between other adjacent two of the protuberance ribs.

In operation, the air flow is guided from the air flow inlet, through channels defined between the vortex generator and the heat transfer tube, and passes out of the air flow outlet, thereby speeding the air flow and promoting the heat transfer efficiency of a stagnation area behind the tube, and generating vortexes at the protuberance ribs and the air flow outlet for draining outer air into the surface for better air mixing.

DETAILED DESCRIPTION OF THE PREFERRED EMBODIMENTS

Figure 1:
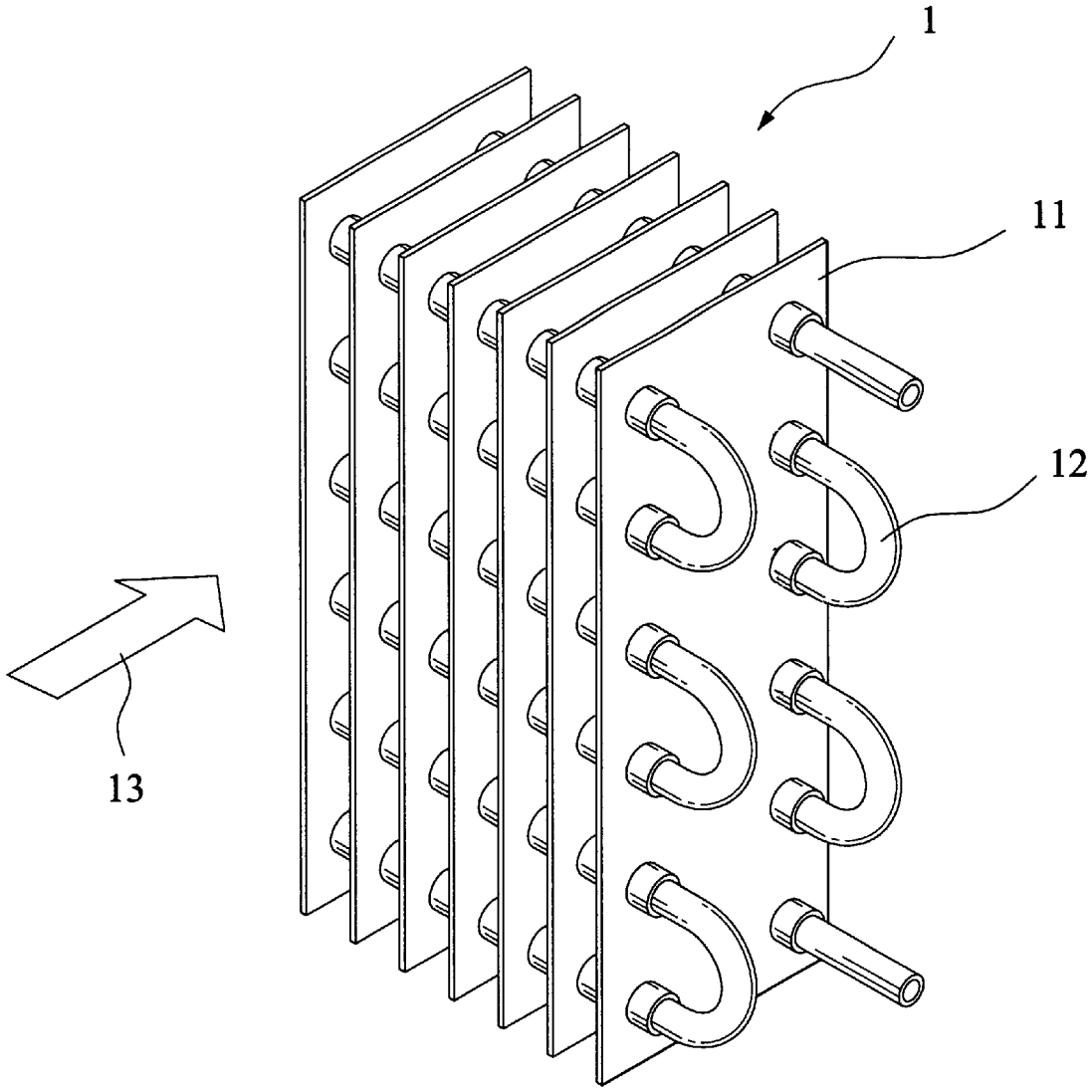
FIG.1(Prior Art)
FIG. 1 is a perspective view of a traditional fin-tube heat exchanger.
Figure 2:
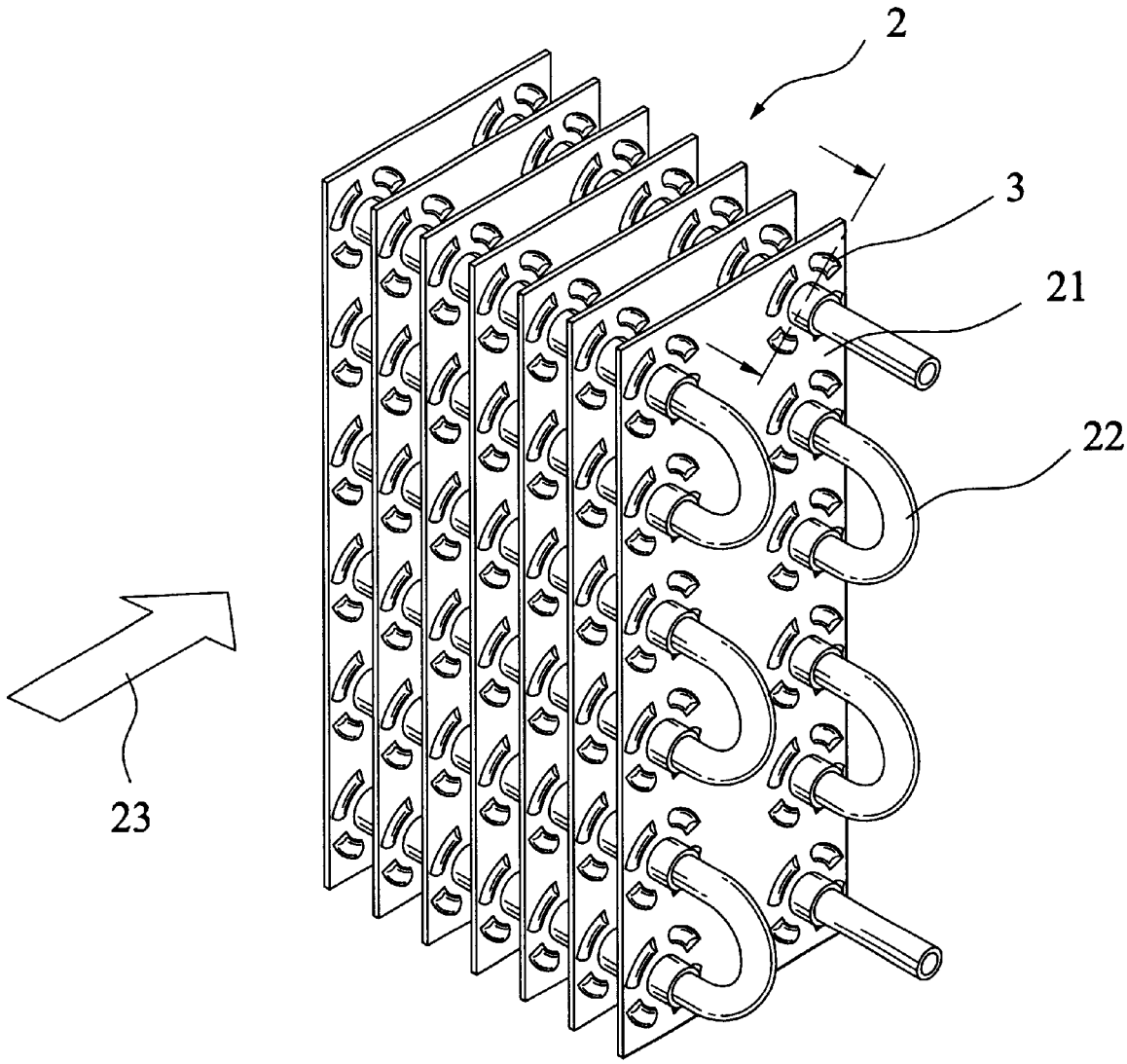
FIG. 2 is a perspective view of a fin-tube heat exchanger in accordance with a first embodiment of the present invention.

Referring to FIG. 2, a fin-tube heat exchanger 2 in accordance with the present invention also comprises a plurality of fins 21 spaced away adjacent ones and a plurality of heat transfer tubes 22 extending through the fins 21. An air flow may pass through a gap between adjacent fins 21. A vortex generator 3 is formed around the heat transfer tube 22 for guiding the air flow 23 to create vortex around the heat transfer tube 22 in order to promote the dissipation efficiency of the fin 21.

Figure 3:
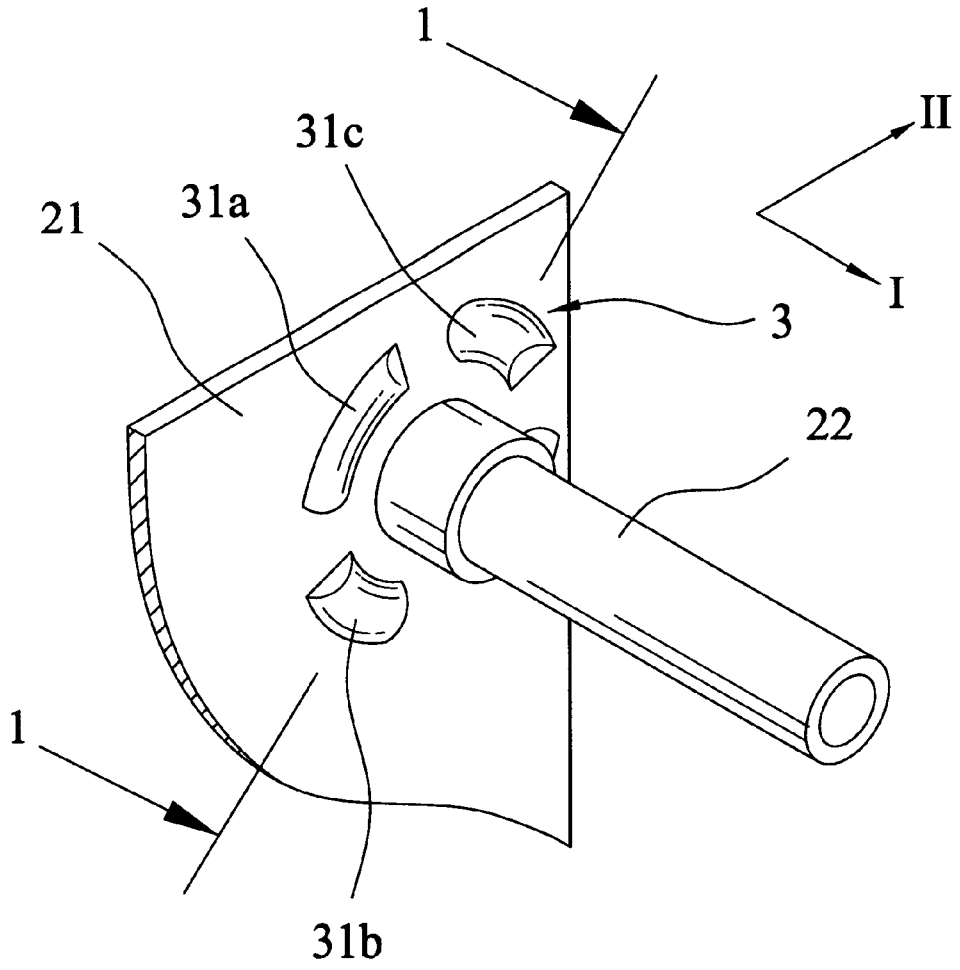
FIG. 3 is an enlarged view of a portion of a fin of FIG. 2 and the heat transfer tube and vortex generator fixed on the fin.
Figure 4:
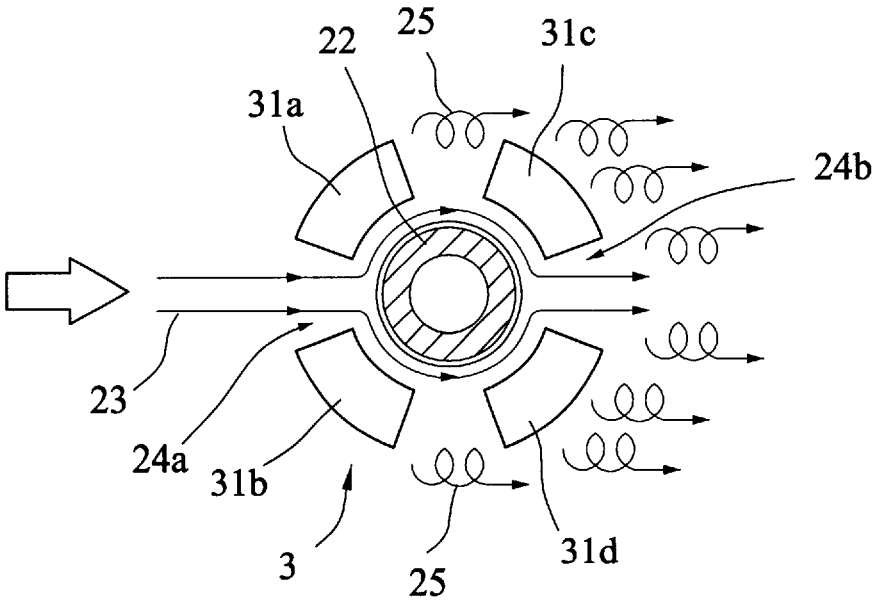
FIG. 4 is a schematic view showing that a vortex generator is configured around a heat transfer tube for guiding air flow to form vortex around the heat transfer tube.
Figure 5:
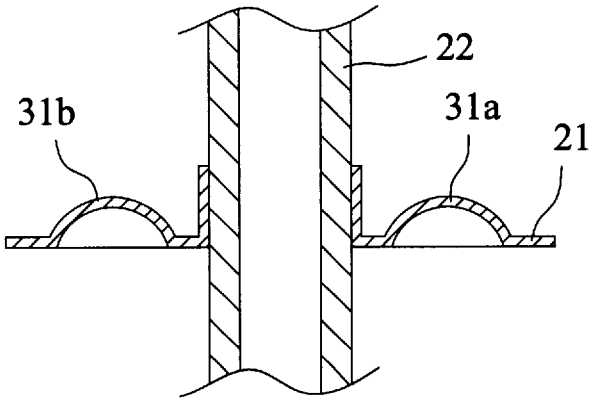
FIG. 5 is a cross-sectional view taken from line 1—1 of FIG. 3.

FIG. 3 is a partial enlarged view of FIG. 2, illustrating the fin 21, the heat transfer tube 22 and the vortex generator 3. FIG. 4 is a schematic view showing that the vortex generator 3 is configured around the heat transfer tube 22 for guiding the air flow 23 to form vortex 25 around the heat transfer tube 22. FIG. 5 is a cross-sectional view taken from line 1—1 of FIG. 3. In the first embodiment, the vortex generator 3 comprises two front protuberance ribs 31*a*, 31*b* and two rear protuberance ribs 31*c*, 31*d*. The front protuberance ribs 31*a*, 31*b* are symmetric with respect to the air flow 23. Similarly, the rear protuberance ribs 31*c*, 31*d* are also symmetric with respect to the air flow 23. Each protuberance rib 31*a*, 31*b*, 31*c*, 31*d* has a arc shape. The protuberance ribs 31*a*, 31*b*, 31*c*, 31*d* are arranged around the heat transfer tube 22. Specifically, the heat transfer tube 22 is the physical center of the four protuberance ribs 31*a*, 31*b*, 31*c*, 31*d*. The protuberance ribs 31*a*, 31*b*, 31*c*, 31*d* are projected from one face of the fin 21 and each protuberance rib forms an arc shape along an extended direction II of the fin 21.

The protuberance ribs 31*a*, 31*b*, 31*c*, 31*d* are spaced away from each other, wherein an air flow inlet 24*a* is defined between the two front protuberance ribs 31*a*, 31*b*, while an air flow outlet 24*b* is defined between the two rear protuberance ribs 31*c*, 31*d*.

When the air flow 23 is guided from the inlet 24*a* to the outlet 24*b*, due to the affection of the protuberance ribs 31*a*, 31*b*, 31*c*, 31*d*, the air flow 23 will be strengthened and passes through channels defined between the heat transfer tube 22 and the protuberance ribs 31*a*, 31*b*, 31*c*, 31*d* and force the wake lagged in the stagration area ,i.e., the outlet 24*b*, to move forward thereby increasing the heat transmission efficiency between the heat transfer tube 22 and the protuberance ribs 31*a*, 31*b*, 31*c*, 31*d*.

Meanwhile, co-rotating or counter-rotating vertex 25 are formed at two sides of the air flow 23 and the outlet 24*b* for draining outer air into the fin 21 in order to promote the heat transfer effect.

Since the heat transfer effect is the poorest at the stagnation area, i.e., the outlet 24*b*, it has been improved considerably by the vortex generator 3 yet not increasing the pressure drop significantly.

The design of the first embodiment of the present invention is quite different from the traditional louver or slit fin, because the traditional structure promotes the heat transfer efficiency by damaging the heat boundary layer which causes a drawback of increasing the pressure drop significantly. The vortex generator can promote the heat transfer efficiency without introducing considerable pressure drop. In applications, the vortex generator is suitable for both plain and wavy fin.

Figure 6A:
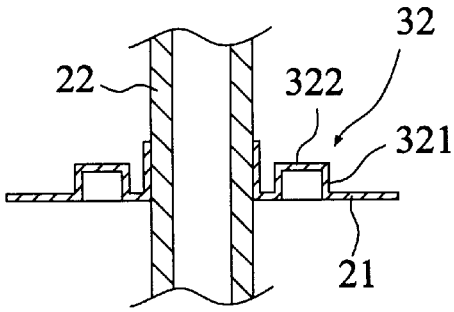
FIGS. 6A to 6F illustrate different designs of the protuberance ribs of the first embodiment of FIG. 2.
Figure 6B:
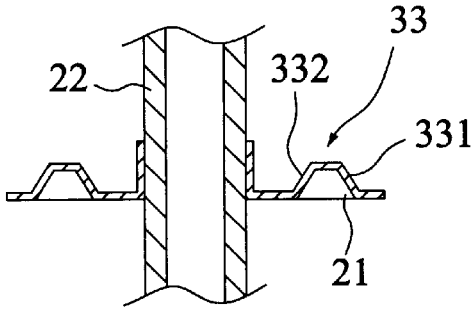
Figure 6C:
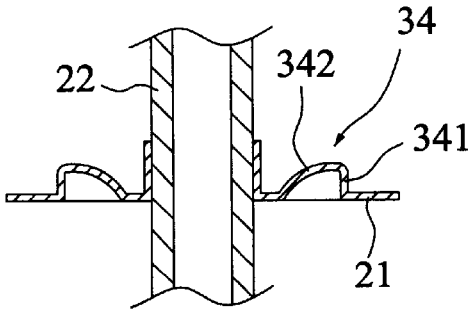
Figure 6D:
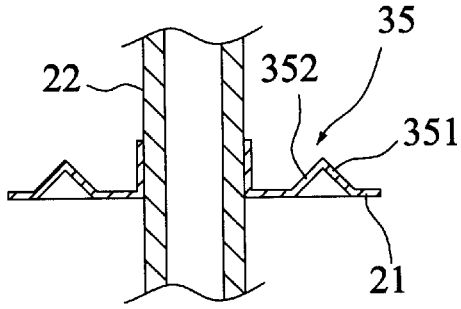
Figure 6E:
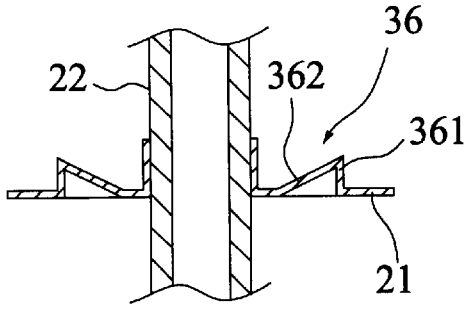
Figure 6F:
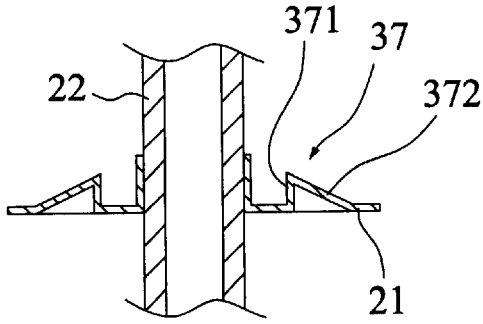

The protuberance rib 31*a*, 31*b*, 31*c*, 31*d* may have different structures. FIGS. 6A to 6F illustrate different structures of the protuberance ribs in cross-sectional views. FIG. 6A illustrates a protuberance rib 32 having two vertical side walls 321 and a horizontal top wall 322 connected between the vertical side walls 321. FIG. 6B illustrates a protuberance rib 33 having two sloped side walls 331 and a horizontal top wall 332 connected between the sloped side walls 331. FIG. 6C illustrates a protuberance rib 34 having a vertical side wall 321 connected to a curved wall 342. FIG. 6D illustrates a protuberance rib 35 having two sloped walls 351, 352 connected to form a triangular shape. FIG. 6E illustrates a protuberance rib 36 having a vertical wall 361 and a sloped wall 362 connected to the vertical wall 361, wherein the sloped wall 362 is located between the vertical wall 361 and the heat transfer tube 22. FIG. 6F illustrates a protuberance rib 37 having a vertical wall 371 and a sloped wall 372 connected to the vertical wall 371, wherein the vertical wall 371 is located between the sloped wall 372 and the heat transfer tube 22.

Figure 7:
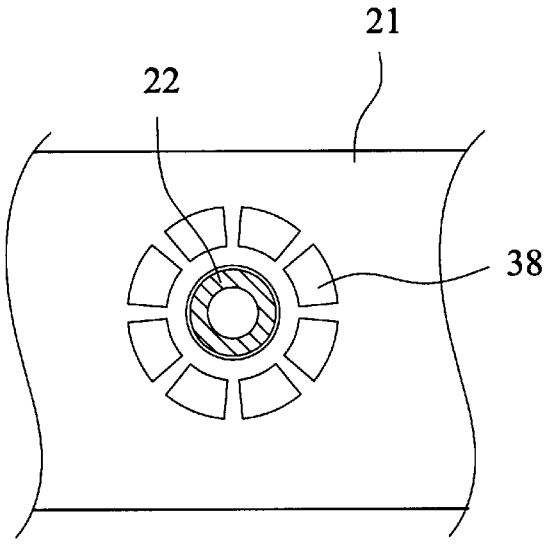
FIG. 7 is a plan view of a fin-tube heat exchanger in accordance with a second embodiment of the present invention.

FIG. 7 is a plan view of a fin-tube heat exchanger in accordance with a second embodiment of the present invention. In the second embodiment, most of the structure is the same as that of the first embodiment except that the number of the protuberance ribs 38 in the second embodiment is increased compared to that of the first embodiment. For example, the number of the protuberance ribs 38 may be eight and each protuberance rib 38 has a corresponding one symmetric to the virtual line of the air flow. The air flow path, the vortex generating theory, and the heat transfer effect are the same to those of the first embodiment thus the description thereof is omitted herein.

Figure 8:
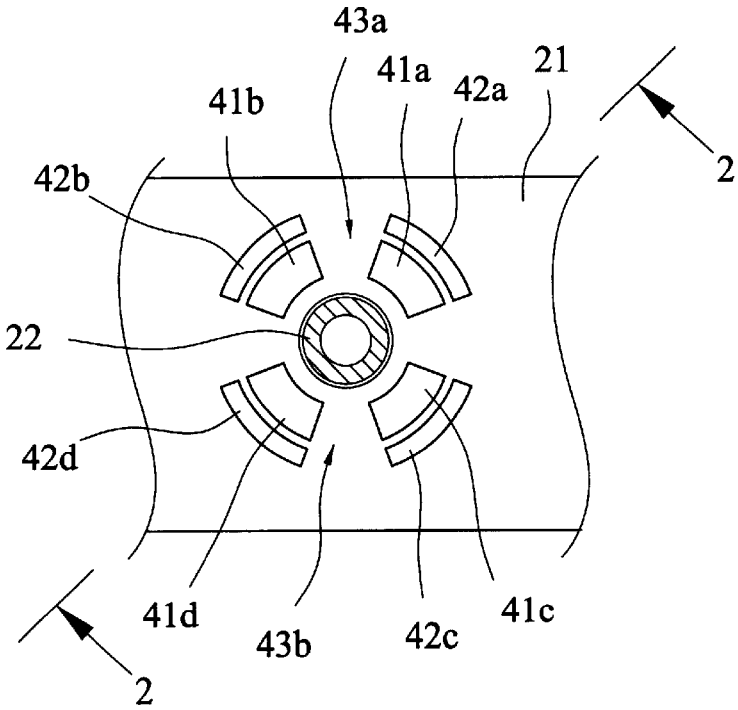
FIG. 8 is a plan view of a fin-tube heat exchanger in accordance with a third embodiment of the present invention.

FIG. 8 is a plan schematic view of a fin-tube heat exchanger in accordance with a third embodiment of the present invention. In the third embodiment, the fin 21 has four inner protuberance ribs 41*a*, 41*b*, 41*c*, 41*d* formed around the heat transfer tube 22 and centralized with the heat transfer tube 22. The arrangement and shapes of the four inner protuberance ribs 41*a*, 41*b*, 41*c*, 41*d* are the same as those of the first embodiment shown in FIG. 4. Four outer protuberance ribs 42*a*, 42*b*, 42*c*, 42*d* are also formed around and centralized with the heat transfer tube 22 and respectively correspond to the inner protuberance ribs 41*a*, 41*b*, 41*c*, 41*d*. Each outer protuberance rib 42*a*, 42*b*, 42*c*, 42*d* is spaced from each corresponding inner protuberance rib 41*a*, 41*b*, 41*c*, 41*d* a predetermined distance. The outer protuberance ribs 42*a*, 42*b*, 42*c*, 42*d* are projected from one side of the fin 21, while the corresponding inner protuberance ribs 41*a*, 41*b*, 41*c*, 41*d* are projected from an opposite side of the fin 21. The cross-sectional view thereof may be referred to FIG. 9.

Except to the addition of the outer protuberance ribs 42*a*, 42*b*, 42*c*, 42*d*, the air flow path, the vortex generating theory, and the heat transmission effect are similar to those of the first embodiment. For example, there are two inner protuberance ribs 41*a*, 41*b* function as front inner protuberance ribs and an air flow inlet 43*a* is defined between the two front protuberance ribs 41*a*, 41*b*. Similarly, there are other two inner protuberance ribs 41*c*, 41*d* function as rear inner protuberance ribs and an air flow outlet 43*b* is defined between the two rear inner protuberance ribs 41*c*, 41*d*.

Figure 9:
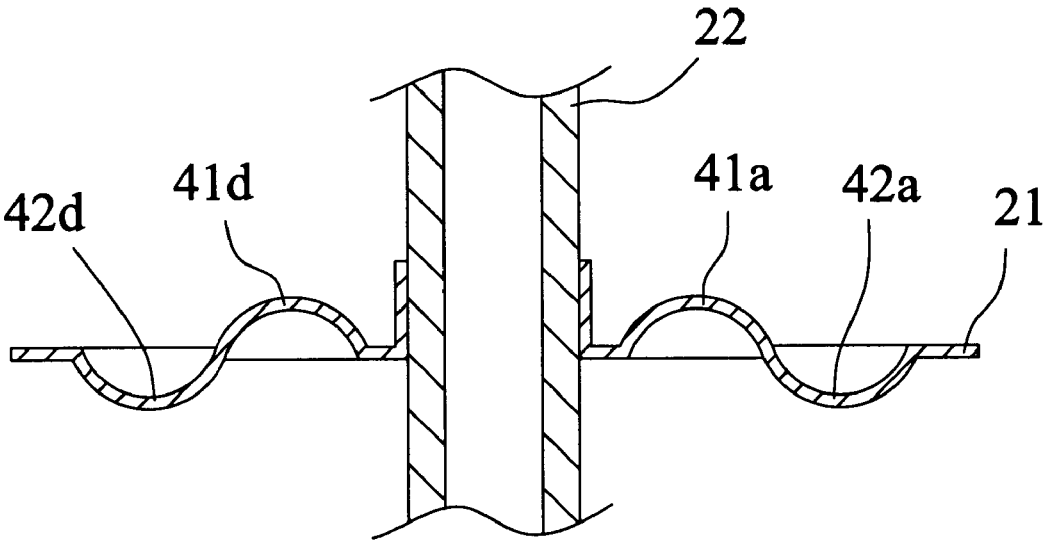
FIG. 9 is a cross-sectional view taken from line 2—2 of FIG. 8.

Referring to FIG. 9, the inner protuberance ribs 41*a*, 41*d* are symmetric to the heat transfer tube 22 and the corresponding outer protuberance ribs 42*a*, 42*d* are also symmetric to the heat transfer tube 22. The inner and outer protuberance ribs 41*a*, 42*a* forms a wave shape and same of the inner and outer protuberance ribs 41*d*, 42*d*. The corresponding pair of the inner and outer protuberance ribs may have different structures as shown in the cross-sectional views of FIGS. 10A to 10F.

Figure 10A:
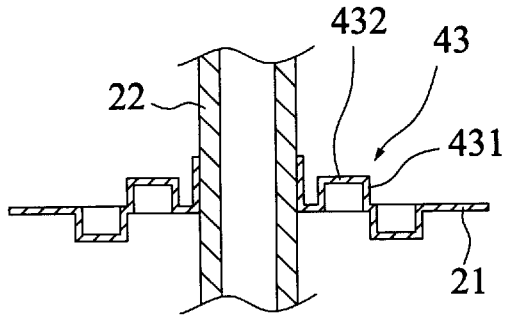
FIGS. 10A to 10F illustrate different designs of the protuberance ribs of the third embodiment of FIG. 8.
Figure 10B:
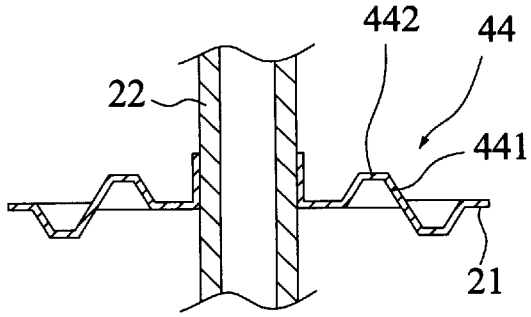
Figure 10C:
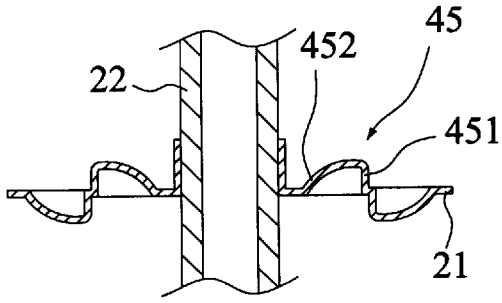
Figure 10D:
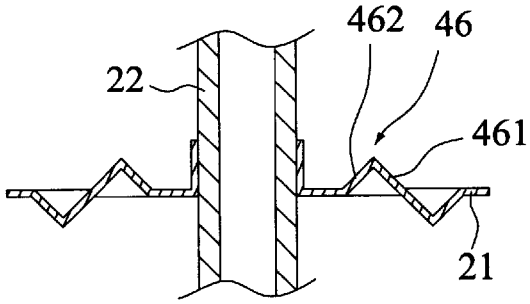
Figure 10E:
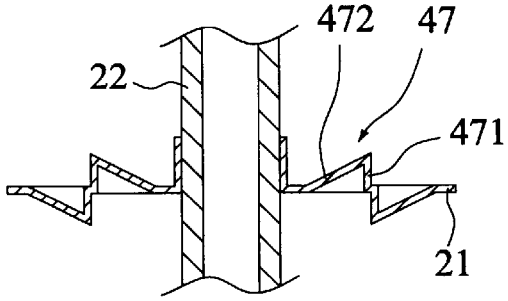
Figure 10F:
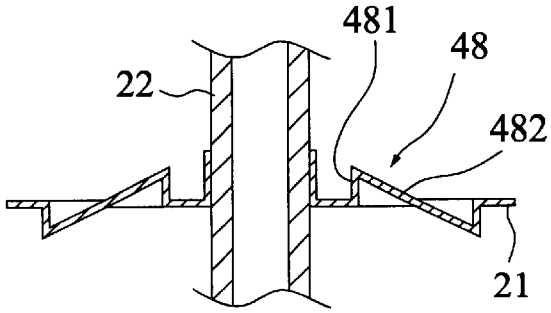

FIG. 10A illustrates an inner protuberance rib 43 having two vertical side walls 431 and a horizontal top wall 432 connected between the vertical side walls 431. FIG. 10B illustrates an inner protuberance rib 44 having two sloped side walls 441 and a horizontal top wall 442 connected between the sloped side walls 441. FIG. 10C illustrates an inner protuberance rib 45 having a vertical side wall 451 connected to a curved wall 452. FIG. 10D illustrates an inner protuberance rib 46 having two sloped walls 461, 462 connected to form a triangular shape. FIG. 10E illustrates an inner protuberance rib 47 having a vertical wall 471 and a sloped wall 472 connected to the vertical wall 471, wherein the sloped wall 472 is located between the vertical wall 471 and the heat transfer tube 22. FIG. 10F illustrates an inner protuberance rib 48 having a vertical wall 481 and a sloped wall 482 connected to the vertical wall 481, wherein the vertical wall 481 is located between the sloped wall 482 and the heat transfer tube 22. The above mentioned inner protuberance ribs each has its corresponding outer protuberance rib projected to an opposite direction, while another pair of inner and outer protuberance ribs are symmetric to the heat transfer tube 22 as shown in FIGS. 10A to 10F.

Figure 11:
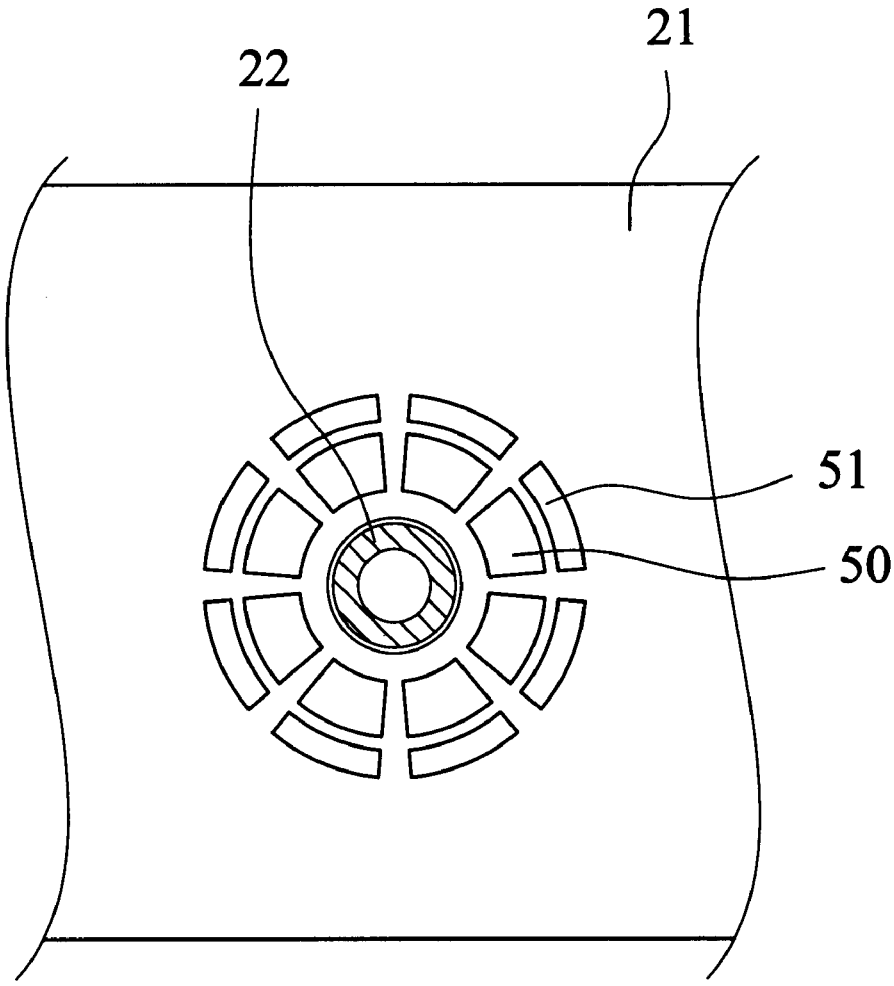
FIG. 11 is a plan view of a fin-tube heat exchanger in accordance with a fourth embodiment of the present invention.

FIG. 11 is a plan view of a fin-tube heat exchanger in accordance with a fourth embodiment of the present invention. Similar to the third embodiment, a plurality of inner protuberance ribs 50 and outer protuberance ribs 51 are formed around and centralized with the heat transfer tube 22. The only difference is that the number of the protuberance ribs 50, 51 in this embodiment is more than that of the third embodiment.

In practice, the present invention can be used in air conditioners and air-cooled heat exchangers. The fin may be plain type or wavy type. The vortex generator of the present invention can cause a pair of co-rotating or counter-rotating vortex vortexes for draining outer new air into the surface of the heat exchanger in order to improve the heat transfer efficiency of the stagnation-lagged area behind the heat transfer tube thereby promoting the total heat transfer efficiency of the heat exchanger.

While the present invention has been described with reference to specific embodiments, the description is illustrative of the invention and is not to be construed as limiting the invention. Therefore, various modifications to the present invention can be made to the preferred embodiments by those skilled in the art without departing from the true spirit and scope of the invention as defined by the appended claims.

What is claimed is:

1. A heat exchanger comprising:

a plurality of fins spaced from each other in parallel and allowing an air flow to pass through a gap therebetween;

a plurality of heat transfer tubes extending through the fins; and a plurality of vortex generators respectively formed on the plurality of fins and corresponding to each of the plurality of heat transfer tubes, each of the vortex generators comprising a plurality of protuberance ribs formed on a corresponding fin around a respective centrally disposed heat transfer tube, each of the protuberance ribs having an arcuate contour in a plane normal to the respective heat transfer tube, the plurality of arcuate protuberance ribs together forming a circular pattern concentrically spaced from the respective heat transfer tube, an air flow inlet being defined between an adjacent two of the protuberance ribs and an air flow outlet being defined between another adjacent two of the protuberance ribs;

wherein the air flow is guided from the air flow inlet, through channels defined between the plurality of protuberance ribs and the heat transfer tube, and passes out of the air flow outlet, thereby speeding the air flow, and generating vortexes at the protuberance ribs and the air flow outlet for drawing outer air to the heat exchanger for air mixing.

2. A heat exchanger, comprising:

a plurality of fins spaced from each other in parallel and allowing an air flow to pass through a gap therebetween;

a plurality of heat transfer tubes extending through the fins; and a plurality of vortex generators respectively formed on the plurality of fins and corresponding to each of the plurality of heat transfer tubes, each of the vortex generators comprising a plurality of protuberance ribs formed on a corresponding fin around a respective centrally disposed heat transfer tube, an air flow inlet being defined between an adjacent two of the protuberance ribs and an air flow outlet being defined between another adjacent two of the protuberance ribs, each protuberance rib having a vertical wall connected to a sloped wall and the vertical wall being located between a respective heat transfer tube and the sloped wall;

wherein the air flow is guided from the air flow inlet, through channels defined between the plurality of protuberance ribs and the heat transfer tube, and passes out of the air flow outlet, thereby speeding the air flow, and generating vortexes at the protuberance ribs and the air flow outlet for drawing outer air to the heat exchanger for air mixing.

3. A heat exchanger, comprising:

a plurality of fins spaced from each other in parallel and allowing an air flow to pass through a gap therebetween;

a plurality of heat transfer tubes extending through the fins; and a plurality of vortex generators respectively formed on the plurality of fins and corresponding to each of the plurality of heat transfer tubes, each of the vortex generators comprising a plurality of protuberance ribs formed on a corresponding fin around a respective centrally disposed heat transfer tube, an air flow inlet being defined between an adjacent two of the protuberance ribs and an air flow outlet being defined between another adjacent two of the protuberance ribs, each protuberance rib having a vertical wall connected to a sloped wall and the sloped wall being located between a respective heat transfer tube and the vertical wall;

wherein the air flow is guided from the air flow inlet, through channels defined between the plurality of protuberance ribs and the heat transfer tube, and passes out of the air flow outlet, thereby speeding the air flow, and generating vortexes at the protuberance ribs and the air flow outlet for drawing outer air to the heat exchanger for air mixing.

4. A heat exchanger comprising:

a plurality of fins spaced from each other in parallel and allowing an air flow to pass through a gap therebetween;

a plurality of heat transfer tubes extending through the fins; and a plurality of vortex generators respectively formed on the plurality of fins and corresponding to each of the plurality of heat transfer tubes, each of the vortex generators comprising (a) a plurality of inner protuberance ribs formed on a corresponding fin around a respective centrally disposed heat transfer tube, each of the inner protuberance ribs extending from a first surface of the corresponding fin in a first direction and having an arcuate contour in a plane normal to the respective heat transfer tube, the plurality of arcuate inner protuberance ribs together forming a circular pattern concentrically spaced from the respective heat transfer tube, a first air flow inlet being defined between an adjacent two of the inner protuberance ribs and a first air flow outlet being defined between another adjacent two of the inner protuberance ribs; and (b) a plurality of outer protuberance ribs formed on the corresponding fin around the centrally disposed heat transfer tube and in respective radial alignment with the inner protuberance ribs, each of the outer protuberance ribs extending from a second surface of the corresponding fin in a second direction, the second direction being opposite the first direction, each of the outer protuberance ribs having an arcuate contour in a plane normal to the respective heat transfer tube, the plurality of arcuate outer protuberance ribs together forming a circular pattern concentrically spaced from the circular pattern of the inner protuberance ribs, a second air flow inlet being defined between an adjacent two of the outer protuberance ribs and a second air flow outlet being defined between another adjacent two of the outer protuberance ribs;

wherein the air flow is respectively guided from the first and second air flow inlets, through channels defined between the inner and outer protuberance ribs and between the inner protuberance ribs and the heat transfer tube, and respectively pass out of the first and second air flow outlets, thereby speeding the air flow and drawing wake lagged air in the first and second air flow outlets away from the first and second air flow outlet, and generating vortexes at the inner and outer protuberance ribs and the first and second air flow outlets for drawing outer air to the heat exchanger for air mixing.

5. A heat exchanger, comprising:

a plurality of fins spaced from each other in parallel and allowing an air flow to pass through a gap therebetween;

a plurality of heat transfer tubes extending through the fins; and a plurality of vortex generators respectively formed on the plurality of fins and corresponding to each of the plurality of heat transfer tubes, each of the vortex generators comprising (a) a plurality of inner protuberance ribs formed on a corresponding fin around a respective centrally disposed heat transfer tube, a first air flow inlet being defined between an adjacent two of the inner protuberance ribs and a first air flow outlet being defined between another adjacent two of the inner protuberance ribs; and (b) a plurality of outer protuberance ribs formed on the corresponding fin around the centrally disposed heat transfer tube and in respective radial alignment with the inner protuberance ribs, a second air flow inlet being defined between an adjacent two of the outer protuberance ribs and a second air flow outlet being defined between another adjacent two of the outer protuberance ribs, each of the inner and outer protuberance ribs having a vertical wall connected to a curved wall;

wherein the air flow is guided from the second and first air flow inlets, through channels defined between the inner and outer protuberance ribs and between the inner protuberance ribs and the heat transfer tube, and passes out of the first and second air flow outlets, thereby speeding the air flow and drawing wake lagged air in the first and second air flow outlets away from the first and second air flow outlet, and generating vortexes at the inner and outer protuberance ribs and the first and second air flow outlets for drawing outer air to the heat exchanger for air mixing.

6. A heat exchanger, comprising:

a plurality of fins spaced from each other in parallel and allowing an air flow to pass through a gap therebetween;

a plurality of heat transfer tubes extending through the fins; and a plurality of vortex generators respectively formed on the plurality of fins and corresponding to each of the plurality of heat transfer tubes, each of the vortex generators comprising (a) a plurality of inner protuberance ribs formed on a corresponding fin around a respective centrally disposed heat transfer tube, a first air flow inlet being defined between an adjacent two of the inner protuberance ribs and a first air flow outlet being defined between another adjacent two of the inner protuberance ribs; and (b) a plurality of outer protuberance ribs formed on the corresponding fin around the centrally disposed heat transfer tube and in respective radial alignment with the inner protuberance ribs, a second air flow inlet being defined between an adjacent two of the outer protuberance ribs and a second air flow outlet being defined between another adjacent two of the outer protuberance ribs, each of the inner and outer protuberance ribs having a vertical wall connected to a sloped wall and the vertical wall being located between the heat transfer tube and the sloped wall;

wherein the air flow is guided from the second and first air flow inlets, through channels defined between the inner and outer protuberance ribs and between the inner protuberance ribs and the heat transfer tube, and passes out of the first and second air flow outlets, thereby speeding the air flow and drawing wake lagged air in the first and second air flow outlets away from the first and second air flow outlet, and generating vortexes at the inner and outer protuberance ribs and the first and second air flow outlets for drawing outer air to the heat exchanger for air mixing.

7. A heat exchanger, comprising:

a plurality of fins spaced from each other in parallel and allowing an air flow to pass through a gap therebetween;

a plurality of heat transfer tubes extending through the fins; and a plurality of vortex generators respectively formed on the plurality of fins and corresponding to each of the plurality of heat transfer tubes, each of the vortex generators comprising (a) a plurality of inner protuberance ribs formed on a corresponding fin around a respective centrally disposed heat transfer tube, a first air flow inlet being defined between an adjacent two of the inner protuberance ribs and a first air flow outlet being defined between another adjacent two of the inner protuberance ribs; and (b) a plurality of outer protuberance ribs formed on the corresponding fin around the centrally disposed heat transfer tube and in respective radial alignment with the inner protuberance ribs, a second air flow inlet being defined between an adjacent two of the outer protuberance ribs and a second air flow outlet being defined between another adjacent two of the outer protuberance ribs, each of the inner and outer protuberance ribs having a vertical wall connected to a sloped wall and the sloped wall being located between the heat transfer tube and the vertical wall;

wherein the air flow is guided from the second and first air flow inlets, through channels defined between the inner and outer protuberance ribs and between the inner protuberance ribs and the heat transfer tube, and passes out of the first and second air flow outlets, thereby speeding the air flow and drawing wake lagged air in the first and second air flow outlets away from the first and second air flow outlet, and generating vortexes at the inner and outer protuberance ribs and the first and second air flow outlets for drawing outer air to the heat exchanger for air mixing.

* * * * *

US006349761C1

(12) INTER PARTES REEXAMINATION CERTIFICATE (628th)

United States Patent

Liu et al.

(10) Number: US 6,349,761 C1

(45) Certificate Issued: Jun. 28, 2013

(54) FIN-TUBE HEAT EXCHANGER WITH VORTEX GENERATOR

(75) Inventors: Min-Sheng Liu, Hsinchu Hsian (TW); Chi-Chung Wang, Hsinchu Hsian (TW); Jane-Sunn Liaw, Hsinchu Hsian (TW); Yu-Juei Chang, Hsinchu Hsian (TW)

(73) Assignee: Industrial Technology Research Institute, Chutung Town, Hsinchu Hsian (TW)

Reexamination Request:
No. 95/002,318, Sep. 14, 2012

Reexamination Certificate for:

| | |
|---|---|
| Patent No.: | **6,349,761** |
| Issued: | **Feb. 26, 2002** |
| Appl. No.: | **09/747,999** |
| Filed: | **Dec. 27, 2000** |

(51) Int. Cl.

| | |
|---|---|
| ***F28F 1/32*** | (2006.01) |
| ***F28F 13/12*** | (2006.01) |
| ***F28F 13/00*** | (2006.01) |
| ***F28D 1/04*** | (2006.01) |

(52) U.S. Cl.
USPC ... 165/151; 165/150; 165/181; 165/DIG. 503

(58) Field of Classification Search
None
See application file for complete search history.

(56) References Cited

To view the complete listing of prior art documents cited during the proceeding for Reexamination Control Number 95/002,318, please refer to the USPTO's public Patent Application Information Retrieval (PAIR) system under the Display References tab.

*Primary Examiner* — Sara Clarke

(57) ABSTRACT

A fin-tube heat exchanger with a vortex generator is disclosed. The heat exchanger includes at least one heat transfer tube extending therethrough. A vortex generator is formed on the fin and includes a plurality of protuberance ribs projected from the fin and centralized with the heat transfer tube. An air flow inlet is defined between adjacent two of the protuberance ribs and an air flow outlet is defined between other adjacent two of the protuberance ribs. The air flow is guided from the air flow inlet, through channels defined between the vortex generator and the at least one heat transfer tube, and passes out of the air flow outlet, thereby speeding the air flow and promoting the heat transfer efficiency of a stagnation area behind the tube, and generating vortexes at the protuberance ribs and the air flow outlet for draining outer air into the surface for better air mixing and promoting the heat transfer efficiency of the fin.

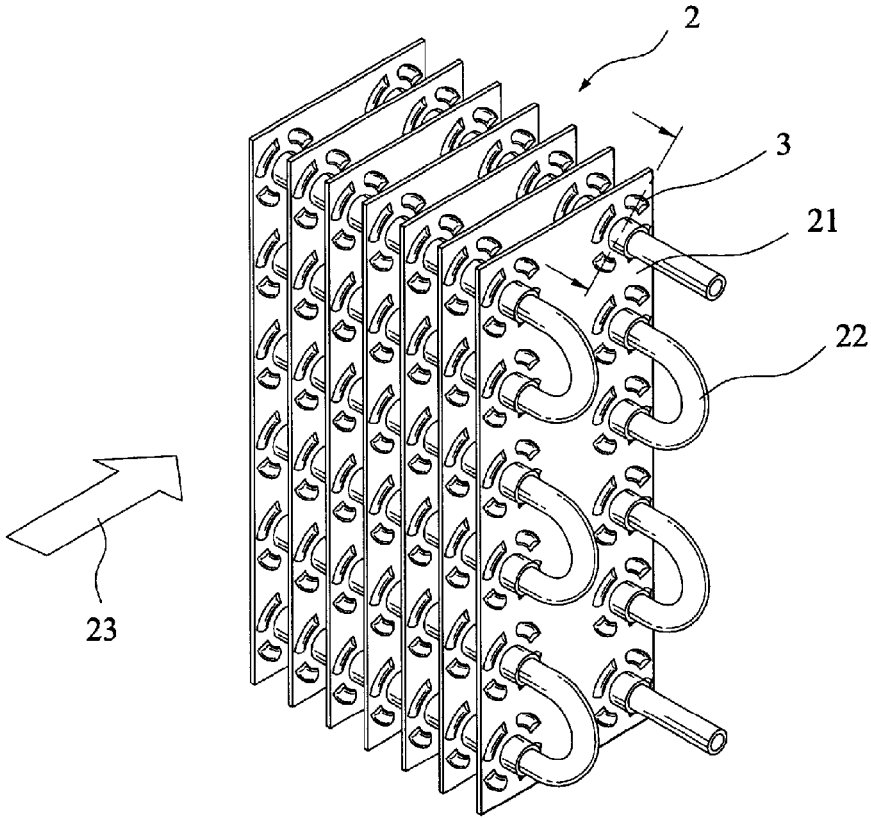

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claim 1 is cancelled.

Claims 2-7 were not reexamined.

* * * * *